US005547550A

United States Patent [19]

Kuntzburger et al.

[11] Patent Number: 5,547,550

[45] Date of Patent: Aug. 20, 1996

[54] PREPARATION PROCESS FOR A MICROPOROUS DIAPHRAGM AND THE DIAPHRAGM PRODUCED THEREBY

[75] Inventors: Frédéric Kuntzburger, Le Plessis-Bouchard; Jean-Claude Magne, La Courneuve, both of France

[73] Assignee: Rhone-Poulenc Chimie, Courbevoie Cedex, France

[21] Appl. No.: 343,450

[22] PCT Filed: Mar. 28, 1994

[86] PCT No.: PCT/FR94/00342

§ 371 Date: Dec. 15, 1994

§ 102(e) Date: Dec. 15, 1994

[87] PCT Pub. No.: WO94/23093

PCT Pub. Date: Oct. 13, 1994

[30] Foreign Application Priority Data

Mar. 26, 1993 [FR] France ..... 93 03486

[51] Int. Cl.[6] ..... C25B 13/04; C25B 13/06

[52] U.S. Cl. ..... 204/252; 204/296; 427/243; 427/245; 427/385.5; 427/397.7; 427/379

[58] Field of Search ..... 204/296, 252; 427/243, 245, 385.5, 397.7, 379

[56] References Cited

U.S. PATENT DOCUMENTS 4,665,120 5/1987 Hruska et al. ..... 204/296
5,092,977 3/1992 Bachot et al. ..... 204/252

FOREIGN PATENT DOCUMENTS 0412916 2/1991 European Pat. Off. .

*Primary Examiner*—Kathryn Gorgos
*Attorney, Agent, or Firm*—Burns, Doane, Swecker & Mathis, L.L.P.

[57] ABSTRACT

Diaphragm for use in cells for the electrolysis of alkaline halide solutions comprising: 100 parts by weight of asbestos fibers, 30 to 70 parts by weight of silica-based derivatives and 20 to 60 parts by weight of fluorinated polymers, deposited on a porous material. The weight ratio of the fluorinated polymers and the silica-based derivatives is between 0.6 to 1.2 and preferably between 0.6 to 0.9 with the exception of a diaphragm obtained by depositing a suspension comprising 100 parts by dry weight of asbestos fibers, 30 parts by dry weight of silica-based derivatives, 25 parts by dry weight of fluorinated polymers and 1.5 parts by dry weight of a thickening agent. The invention also concerns a method for the preparation of an optionally microporous diaphragm. The diaphragms of the invention are especially useful in aqueous alkaline halide solutions electrolysis cells.

21 Claims, No Drawings

PREPARATION PROCESS FOR A MICROPOROUS DIAPHRAGM AND THE DIAPHRAGM PRODUCED THEREBY

The present invention concerns a diaphragm for use in electrolyzer units for alkali halide solutions.

It also concerns a process for the preparation of a diaphragm which may optionally be microporous. The diaphragm mentioned above can be produced by this process.

Finally, it concerns the use of the diaphragm in an electrolyzer unit for aqueous alkali, halide solutions.

The aqueous alkali halide solution which is most frequently electrolyzed is sodium chloride, to produce chlorine and caustic soda.

This type of material is generally prepared by depositing asbestos fibers on a support, consolidating them with a polymer which is inert towards the electrolyte and optionally adding a pore forming agent which is decomposed at the end of the operation to produce the required porosity.

Known asbestos-based diaphragms produced by that process do not possess all the mechanical and chemical properties required for optimal conditions of electrolysis. The diaphragms either have unsatisfactory hydraulic and/or electrical properties from the outset when used in electrolysis, mainly due to the hydrophobic nature of the diaphragms, or they degrade with time during use of those diaphragms in electrolysis, mainly by structural weakening, reducing the hydraulic and/or electrical properties.

French patent no 73 18805, filed on 18 May 1973 by RHONE-PROGIL, describes a process for the preparation of porous diaphragms from an aqueous suspension of asbestos fibers, a fluorinated resin latex, a pore forming agent and anionic sulphonic surfactants. Specified amounts of fluorinated resin, pore forming agent and asbestos are preferred, which result in microporous diaphragms with electrolysis properties which have been shown to be unsatisfactory; the unsatisfactory properties are due to poor flow of the electrolyte from one compartment to another in the system and/or an increase in tension with no increase in the yield of caustic soda. In addition, the anionic surfactants in the diaphragms react with the cations present during manufacture when the diaphragms are used for electrolysis, reducing their hydraulic and electrical properties One aim of the present invention is thus to provide a microporous diaphragm which, during use in the electrolysis of aqueous solutions of alkali halides, satisfactorily transports the soluble species present in the electrolyte, along with a reduced flow of caustic soda across a separator of given geometry.

A further aim of the present invention is to provide a microporous diaphragm which, during use in electrolysis, has a uniform electrolyte flow from one compartment to another.

A still further aim of the invention is to provide a process for the preparation of a microporous diaphragm with satisfactory hydraulic and electrical properties with regard to the energy consumption of the system in kilowatt hours.

These and other aims are achieved by the present invention which provides a diaphragm comprising:

100 parts by weight of asbestos fibers;

30 to 70 parts by weight of silica-based derivatives;

20 to 60 parts by weight of fluorinated polymer;

deposited on a porous material, wherein the ratio of fluorinated polymer to silica-based derivatives is between 0.6 and 1.2 by weight, preferably between 0.6 and 0.9, with the exception of a diaphragm obtained by depositing a suspension containing 100 parts by dry weight of asbestos fibers, 30 parts by dry weight of silica-based derivatives, 25 parts by dry weight of fluorinated polymer and 1.5 parts by dry weight of a thickening agent.

The invention also concerns a diaphragm comprising:

100 parts by weight of asbestos fibers;

30 to 70 parts by weight of silica-based derivatives;

20 to 60 parts by weight of fluorinated polymer;

deposited on a porous material, wherein the ratio of fluorinated polymer to silica-based derivatives is between 0.6 and 1.2 by weight, preferably between 0.6 and 0.9, obtained by depositing a suspension whose nature and constituents will be defined below, said suspension optionally including a thickening agent in an amount of less than 1.5 parts by dry weight per 100 parts by dry weight of asbestos fibers.

The present invention also concerns a process for the preparation of a diaphragm, substantially comprising the following steps:

a) preparation of an aqueous suspension comprising, as well as a thickening agent if required,:

100 parts by dry weight of asbestos fibers;

30 to 60 parts by dry weight of silica-based derivatives;

20 to 60 parts by dry weight of fluorinated polymer;

b) depositing a coating by programmed vacuum filtration of said suspension through a porous material;

c) eliminating the liquid medium and drying the coating formed;

d) sintering the coating;

the prepared suspension having a weight ratio of fluorinated polymer to silica-based derivatives such that the diaphragm produced has a ratio of fluorinated polymer to silica-based derivatives, following step c), of between 0.6 and 1.2 by weight, preferably between 0.6 and 0.9, with the exception of a diaphragm obtained by depositing a suspension containing 100 parts by dry weight of asbestos fibers, 30 parts by dry weight of silica-based derivatives, 25 parts by dry weight of fluorinated polymer and 1.5 parts by dry weight of a thickening agent.

The invention further concerns a process for the preparation of a diaphragm substantially comprising the following steps:

a) preparing an aqueous suspension comprising:

100 parts by dry weight of asbestos fibers;

30 to 60 parts by dry weight of silica-based derivatives;

20 to 60 parts by dry weight of fluorinated polymer;

0 to less than 1.5 parts by dry weight of a thickening agent;

b) depositing a coating by programmed vacuum filtration of said suspension through a porous material;

c) eliminating the liquid medium and drying the coating formed;

d) sintering the coating;

the prepared suspension .having a weight ratio of fluorinated polymer to silica-based derivatives such that the diaphragm produced has a ratio of fluorinated polymer to silica-based derivatives, following step c), of between 0.6 and 1.2 by weight, preferably between 0.6 and 0.9.

Other advantages and features of the invention will become clearer from the following description and examples.

In a first embodiment, the present invention provides a diaphragm comprising:

100 parts by weight of asbestos fibers;

30 to 70 parts by weight of silica-based derivatives;

20 to 60 parts by weight of fluorinated polymer;

with the exception of a diaphragm obtained by depositing a suspension containing 100 parts by dry weight of asbestos fibers, 30 parts by dry weight of silica-based derivatives, 25 parts by dry weight of fluorinated polymer and 1.5 parts by dry weight of a thickening agent.

In a second embodiment, the diaphragm comprises:

100 parts by weight of asbestos fibers;

30 to 70 parts by weight of silica-based derivatives;

20 to 60 parts by weight of fluorinated polymer;

deposited on a porous material, wherein the ratio of fluorinated polymer to silica-based derivatives is between 0.6 and 1.2 by weight, preferably between 0.6 and 0.9, obtained by depositing a suspension which optionally includes a thickening agent in an amount of less than 1.5 parts by dry weight per 100 parts by dry weight of asbestos fibers.

Preferably, diaphragms according .to the above two embodiments comprise:

100 parts by weight of asbestos fibers;

30 to 60 parts by weight of silica-based derivatives;

25 to 50 parts by weight of fluorinated polymer.

In a further embodiment, the diaphragms are produced by depositing a suspension comprising, in addition to the other constituents described below, 0 to less than 1.5 parts by dry weight, more particularly 0 to 1 part dry weight of a thickening agent per 100 parts by dry weight of asbestos fibers.

Diaphragms in accordance with the invention preferably contain at least one surfactant. This surfactant is present in quantities of between 0.5 and 10, preferably between 0.6 and 5 parts by weight per 100 parts by dry weight of asbestos fibers.

A non ionic surfactant is preferably used. The non ionic surfactant may in particular be an ethoxylated alcohol or a fluorocarbon compound containing a functional group, used either alone or as a mixture: in general, the carbon chain in the alcohol or fluorocarbon compound contains 6 to 20 carbon atoms.

Preferred ethoxylated alcohols are ethoxylated alkylphenols, in particular octoxynols.

Diaphragms in accordance with the present invention advantageously have a weight per unit surface area of between 0.4 and 3 $kg/m^2$, preferably between 0.7 and 2 $kg/m^2$.

The present invention also provides a process for the preparation of a diaphragm.

A first embodiment of the process produces a diaphragm with the exception of that obtained from a suspension comprising 100 parts by dry weight of asbestos fibers, 30 parts by dry weight of silica-based derivatives, 25 parts by dry weight of fluorinated polymer and 1.5 parts by dry weight of a thickening agent.

In this first embodiment, the process substantially consists of the following steps:

a) preparing an aqueous suspension comprising, as well as a thickening agent if required:

100 parts by dry weight of asbestos fibers;

30 to 60 parts by dry weight of silica-based derivatives;

20 to 60 parts by dry weight of fluorinated polymer;

b) depositing a coating by programmed vacuum filtration of said suspension through a porous material;

c) eliminating the liquid medium and drying the coating formed;

d) sintering the coating;

the suspension from step a) having a weight ratio of fluorinated polymer to silica-based derivatives such that the diaphragm produced has a ratio of fluorinated polymer to silica-based derivatives, following step c), of between 0.6 and 1.2 by weight, preferably between 0.6 and 0.9.

In a second embodiment, the process of the invention substantially comprises the following steps:

a) preparing an aqueous suspension comprising:

100 parts by dry weight of asbestos fibers;

30 to 60 parts by dry weight of silica-based derivatives;

20 to 60 parts by dry weight of fluorinated polymer;

0 to less than 1.5 parts by dry weight of a thickening agent;

b) depositing a coating by programmed vacuum filtration of said suspension through a porous material;

c) eliminating the liquid medium and drying the coating formed;

d) sintering the coating;

the prepared suspension having a weight ratio of fluorinated polymer to silica-based derivatives such that the diaphragm produced has a ratio of fluorinated polymer to silica-based derivatives, following step c), of between 0.6 and 1.2 by weight, preferably between 0.6 and 0.9.

It is important that the suspension prepared in each of the two embodiments has a weight ratio of fluorinated polymer to silica-based derivative which is adjusted so that this ratio in the diaphragm produced following step c) is between 0.6 and 1.2 by weight, preferably between 0.6 and 0.9.

This ratio can be varied depending on the respective deposit ratio of the two compounds on the high porosity material. The skilled person can readily determine, by means of simple tests, the amount of dry material which must be dispersed in the suspension as a function of the deposit ratio observed in the porous material through which the dispersion is filtered under programmed vacuum filtration conditions.

The aqueous suspension for step a) in these two embodiments preferably and appropriately comprises, in addition to the thickening agent if used:

100 parts by dry weight of asbestos fibers;

35 to 50 parts by dry weight of silica-based derivatives;

30 to 40 parts by dry weight of fluorinated polymer.

In the process of the present invention, a suspension containing at least one surfactant is preferably used.

The surfactant is generally present in quantities of between 0.5 and 10, preferably between 0.6 and 5 parts by weight per 100 parts by weight of asbestos fibers.

The surfactant is preferably non ionic.

Advantageously, the surfactants used are those mentioned above.

We have shown that, using this process, microporous diaphragms can be prepared which .have satisfactory electrical and hydraulic properties which are stable over time; this can be seen to advantage during use of these diaphragms in brine electrolyzer units at high current densities of 40 $A/dm^2$ and more. The diaphragms produced can be used with high caustic soda concentrations (of the order of 140 to 200 g/l, or more) in the catholyte, limiting the useful energy consumption to the final caustic soda concentration.

As mentioned above, the suspension prepared during step a) may contain a thickening agent.

More particularly, the quantity of thickening agent can be between 0 and less than 1.5 parts by dry weight per 100 parts by dry weight of asbestos fibers.

Preferably, the quantity of thickening agent is between 0 and 1 part dry weight with respect to the above reference.

The thickening agents are generally selected from natural or synthetic polysaccharides. Preferably, the thickening agents are selected from natural polysaccharides such as biogums, produced by fermenting a hydrocarbon using a microorganism. Examples of such compounds are xanthane, gellan, rhamsan and welan gum.

We have discovered that such quantities of thickening agent, especially within the preferred range, are particularly suited to industrial scale preparation of diaphragms. These concentrations of thickening agent, if the suspension contains any, stabilize the suspension to be deposited and produce homogeneous diaphragms while retaining a deposition time which is compatible with industrial objectives.

Commercially available asbestos fibers are advantageously used in the suspension to be deposited. Chrysotile asbestos fibers with a length of 1 to 5 mm and those with a length of less than 1 mm are particularly preferred.

The binder for the materials is constituted by a fluorinated polymer.

The term "fluorinated polymer" means a homopolymer or copolymer derived at least in part from an olefin monomer substituted with a fluorine atom or substituted by a combination of fluorine atoms and at least one atom of chlorine, bromine or iodine per monomer. Examples of fluorinated homopolymers or copolymers are polymers and copolymers derived from tetrafluoroethylene, hexafluoropropylene, chlorotrifluoroethylene and bromotrifluoroethylene.

These polymers may also contain up to 75 molar % of units derived from other unsaturated ethylene-like monomers containing at least as many fluorine atoms as carbon atoms, such as vinylidene (di) fluoride or vinyl or perfluoroalkyl, esters such as perfluoroalkoxyethylene.

Advantageously, the fluorinated polymer is in the form of an aqueous dispersion generally containing 30% to 70% of dry polymer with a granulometry of between 0.1 and 5 micrometers, preferably between 0.1 and 1 micrometer.

Polytetrafluoroethylene is the preferred fluorinated polymer employed.

The term "silica-based derivatives" means precipitated silicas and combustion or pyrogenised silicas.

Advantageously, the silicas used have a BET specific surface area of between 100 $m^2/g$ and 300 $m^2/g$ and/or a granulometry, evaluated with a COULTER$^R$ meter, of between 1 and 50 microns, preferably between 1 and 15 microns.

These derivatives act as excellent porogens which do not weaken the microporous material when used in the quantities employed in the present invention. The derivatives also act as network-forming agents for the latex constituting the binder.

The aqueous suspension prepared in step a ) of the process contains 500 to 10,000 parts of-water per 100 parts by weight of asbestos fibers.

When used for electrolysis, the diaphragm is preferably in the form of a microporous diaphragm i.e., a diaphragm which is substantially free of silica-based derivatives.

The process of the present invention then includes a step e) for eliminating the silica-based derivatives.

The silica-based derivatives can be eliminated by reaction in an alkaline medium. The silica-based derivatives can be eliminated before the diaphragm is used for electrolysis. However, it is practical and advantageous to eliminate the silica-based derivatives "in situ" in the electrolyzer unit by dissolving them in an alkaline medium, particularly during the first hours of electrolysis.

The treatment is thus advantageously carried out in contact with an aqueous sodium hydroxide solution at a concentration of between 40 and 200 g/l and a temperature between 20° C. and 95° C.

In the process of the invention, the coating is formed by programmed vacuum filtration of said suspension through a porous material. The porous material may be a gauze and/or screen with a mesh size, perforation or porosity of between 1 μm and 5 mm, preferably between 20 μm and 2 mm.

When the diaphragm of the invention is used in electrolyzer units for alkali halides or, more specifically, sodium chloride, the porous material may be a porous metallic surface which constitutes the elementary cathode of the electrolyzer unit. The elementary cathodes may have one or more planar or cylindrical surfaces generally known as a "glove finger", presenting an open surface.

In a preferred embodiment, prior to depositing the diaphragm, the cathode is covered with a precathode coating.

This prior step is effected by programmed vacuum filtration through the elementary cathode constituted by a metallic surface with a mesh size or perforations of between 1 μm and 5 mm, preferably between 20 μm and 2 mm, of an aqueous suspension of fibers of which at least a portion is electrically conducting, a fluorinated polymer-based binder in the form of particles, and optional additives, followed by elimination of the liquid medium, drying if necessary of the coating formed and optional sintering of the coating.

The precathode coating is preferably only sintered at this stage of the process when the binder is different to the binder in the suspension prepared in step a) of the process of the invention.

The precathode coating produced thus contains the porous material through which the suspension prepared in step a) of the process of the present invention can be filtered.

Complementary technical details and variations in the precathode coating mentioned above are described in particular in European patent applications EP-A-0 132 425 and EP-A-0 412 916; the subject matter of these European applications is incorporated by reference to avoid further description of said elementary cathodes. The additives may thus be silica-based derivatives, such as those described above for the diaphragm, of may be electrocatalytic agents selected from the group constituted by Raney metals and Raney alloys from which the major part of readily eliminable metal(s) is (are) eliminated, and mixtures thereof.

The vacuum programmes described above, both for deposition of the precathode coating and for the diaphragm of the invention, can be carried out continuously or in steps, from atmospheric pressure to the final pressure (0.01 to 0.5 bars absolute).

The sintering ( or consolidation ) steps mentioned above are generally carried out at a temperature above the melting or softening point of the fluorinated polymers, the binders for said coating The following examples illustrate the invention without limiting its scope.

The percentages quoted in the following description are percentages by weight unless otherwise indicated.

EXAMPLES

The following method was used in the examples to prepare the diaphragm:

A suspension was prepared, with stirring, of:

A - deionized water, the quantity of which was calculated to obtain 4 liters of suspension and an extract of approximately 4.5%;

B - Z g of surfactant;

C - 100 g of chrysotile asbestos fibers of less than 1 mm length;

D - X g of polytetrafluoroethylene (PTFE) in the form of a latex of approximately 60% by weight dry extract;

E - Y g of Tixosil 33 J$^R$ (silica manufactured and sold by RHONE-POULENC).

The suspension was left for at least 24 hours. The suspension was stirred for 30 minutes before use.

A volume of solution was used which contained the amount of dry matter which it was intended to deposit to form the diaphragm (of the order of 1 to 2 kg/m$^2$).

Programmed vacuum filtration was carried out on a cathode on which a precathodic coating had been deposited, as will be described below.

Evacuation was commenced and the pressure was reduced at 50 mbar per minute until a pressure of about 800 mbar was reached.

The vacuum was maintained for 15 minutes at 800 mbar.

The assembly was then sintered, after drying at about 100° C. if required, by bringing the assembly of cathode and diaphragm to 350° C. with a stage at a temperature of about 315° C., over a total period of about one and a half hours.

The silica was then eliminated by alkaline reaction in the caustic soda electrolyte during the first moments of electrolysis ("in situ" elimination ).

The precathode coating was prepared as follows:

30 g of asbestos fibers of less than 1 mm length and 82 ml of Triton X 100$^R$,40 g/l from ROHM & HAAS, were introduced into 7 liters of deionized water, with stirring.

An amount of 70 g of graphite fibers (with a monodispersed length of about 1.5 mm), 35 g of PTFE latex, 100 g of Tixosil 33 J$^R$, 2.1 g of xanthane gum and 60.5 g of Raney nickel were added after stirring.

The suspension was left for about 48 hours.

The suspension was deposited onto a metal screen with a mesh size of 2 mm.

Evacuation was commenced and the pressure was reduced at 10 mbar per minute until a pressure of about 200–300 mbar was reached.

The vacuum was maintained for 15 minutes at 200–300 mbar.

Drying was effected for 1 hour at 120° C.

The electrolyser unit used to measure the property had the following features and operating conditions:

expanded metal anode coated with $RuO_2$- $TiO_2$;

cathode, see description below:

inter-electrode distance 7 mm;

effective surface area 0.5 dm$^2$;

intensity 12.5 A;

brine supply into anode compartment 305 g/l, chloride concentration in the anolyte held constant at 4.8 moles.l$^{-1}$;

cell temperature 85° C.

In the tables given in the examples:

permeability is the flow of electrolyte from one compartment to another, calculated as the simple difference in height observed between the anode and cathode compartments;

ΔU, in volts, is the voltage at the electrolyzer terminals at 12.5 A.

Comparative examples 1 to 3

The following suspensions were prepared:

X=20 g of PTFE;

Y varied: 20, 23 and 27 g of silica;

Z=1.2 g of Triton X 100$^R$ from ROHM & HAAS (30 ml of 40 g/l Triton X 100$^R$).

These examples thus contain an unsuitable silica concentration due to the relatively low PTFE content.

The deposit ratios in the precathode coating constituting the porous material were 100% (deposit ratio calculated by simple material balance: measurement of elements F, Mg and Si by X ray fluorescence and/or by weighing).

The results are summarized in Table 1 below.

Examples 4 and 5

The following suspensions were prepared:

X=20 g of PTFE;

Y varied: 30 and 50 g of silica;

Z=1.2 g of Triton X 100$^R$ from ROHM & HAAS (30 ml of 40 g/l triton X 100$^R$).

The deposit ratios in the precathode coating constituting the porous material were 100% (deposit ratio calculated by simple material balance: measurement of elements F, Mg and Si by X ray fluorescence and/or weighing).

The results are summarized in Table 1 below.

The results obtained from comparative Examples 1, 2 and 3 show that the hydraulic and/or electrical properties were unsatisfactory.

It can also be seen that when the PTFE/silica ratio is 0.4 (Example 5), ΔU and the permeability were less satisfactory than when this ratio was 0.67 (Example 4), even though the yields were comparable. The results obtained from this latter Example 4 appeared good, but were in a critical zone due to insufficient PTFE and a narrow useful zone.

TABLE 1

| EXAMPLES | 1 | | | | 2 | 3 | 4 | | | | 5 | | | |
|---|---|---|---|---|---|---|---|---|---|---|---|---|---|---|
| Composition of asbestos/PTFE/silica suspension | 100/20/20 | | | | 100/20/23 | 100/20/27 | 100/20/30 | | | | 100/20/50 | | | |
| weight deposited | 0.88 | 1.23 | 1.57 | 1.26 | 1.53 | 1.5 | 0.96 | 1.35 | 1.57 | 1.92 | 0.92 | 1.25 | 1.57 | 1.95 |
| Permeability | very low | | | | unstable | unstable | good | | | | high | | | |
| Final ΔU (volt) | 3.32 | 3.33 | 3.3 | 3.51 | 3.20–3.40 unstable | 3.20–3.40 unstable | 3.05 | 3.07 | 3.17 | 3.27 | 3.3 | 3.34 | 3.58 | 3.73 |
| Yield (%) | | | | | | | | | | | | | | |
| of 3.5 N NaOH | 87 | ND | ND | ND | 93 | 94 | 96 | 95 | 98 | 93.5 | 95 | 99 | 98.5 | 95 |
| of 5 N NaOH | 77 | ND | 82.5 | 75 | 85 | 87 | 84.5 | 85 | 88.5 | 88 | 85 | 92 | 91.5 | 88 |

ND: not determined

Examples 6 to 11

The following suspensions were prepared:

X varied: 15, 30 and 40 g of PTFE;

Y=30 g of silica;

Z=1.2 g of Triton X from ROHM & HAAS (30 ml of 40 g/l Triton X 100$^R$).

Examples 6 and 7 thus contained 15 g of PTFE per 100 g of asbestos fibers in the suspension and Examples 10 and 11 had a PTFE/silica ratio of 1.33. These named examples were, therefore, comparative examples.

The deposit ratios of the precathode coating constituting the porous material were 100% (deposit ratio calculated by simple material balance: measurement of elements F, Mg and Si by X ray fluorescence and/or by weighing).

The results are summarized in Table 2 below.

The low PTFE content in Examples 6 and 7 resulted in a high, unstable permeability, but above all risked weakening the diaphragm after several hours of electrolysis (results observed but not apparent from the table), and was thus unsuitable for industrial development.

When, however, the PTFE content was high and the PTFE/silica ratio was 1.33 ( Examples 10 and 11 ), the diaphragm had a hydrophobic character (high tension and low permeability), the caustic soda yield was low and the energy consumption was high.

Energy consumption: 2700–2750 kilowatt hours per ton of chlorine produced.

Examples 13 to 15

Influence of surfactant.

The following suspension was prepared:

X=20 g of PTFE;

Y=30 g of silica;

These examples modified the nature of the surfactant and its concentration in the suspension.

Thus, in these examples, the Triton was completely or partially replaced by sodium dioctyl sulphosuccinate (sulfimel), an anionic surfactant. Identical weights were deposited: 1.34 kg/m$^2$.

The deposit ratios of the precathode coating constituting the porous material were 100% (deposit ratio calculated by simple material balance: measurement of elements F, Mg and Si by X ray fluorescence and/or by weighing).

TABLE 2

| EXAMPLES | 6 | 7 | 8 | 9 | 10 | 11 |
|---|---|---|---|---|---|---|
| Composition of asbestos/PTFE/silica suspension | 100/15/30 | 100/15/30 | 100/30/30 | 100/30/30 | 100/40/30 | 100/40/30 |
| weight deposited (kg/m2) | 1.33 | 1.64 | 1.35 | 1.74 | 1.59 | 1.56 |
| PERMEABILITY | High and unstable | High and unstable | Correct | Correct | Low | Low |
| . U (volt) | 3.1 | 3.25 | 3.1 | 3.35 | 3.5 | 3.7 |
| Caustic soda yield (%) | | | | | | |
| 3.5 N | 97.0 | 98.5 | 94.0 | 92.0 | 80% at 4.3 N | 84% at 4.5 N |
| 5 N | 86.0 | 90.0 | 83.5 | 85.0 | — | — |

Example 12

Long duration electrolysis test:

The following suspension was prepared:

X=25 g of PTFE;

Y=35 g of silica;

Z=1.2 g of Triton X 100$^R$ from ROHM & HAAS (30 ml of 40 g/l Triton X 100$^R$).

The deposit ratios of the precathode coating constituting the porous material were 100% (deposit ratio calculated by simple material balance: measurement of elements F, Mg and Si by X ray fluorescence and/or by weighing).

An amount of 1.59 kg/m$^2$ was deposited.

The hydraulic and electrical properties of the diaphragm during a long duration test were satisfactory.

The caustic soda concentration was varied progressively from 2 to 5 moles. 1$^{-1}$ over the first 300 hours of operation.

The test lasted 2500 hours, maintaining production of caustic soda at a concentration of 5N±0.2N.

Following a transition phase of about 800 hours during which the permeability increased slightly and the tension passed through a minimum, the properties stabilised until the end of the test and were as follows:

NaOH=5N±0.2N;

Tension=3.25 V;

Permeability: correct;

Yield of 5N caustic soda=89–90%;

The results are summarized in Table 3 below.

The sulfimel/Triton ratio in the Table is a weight ratio.

TABLE 3

| Examples | 13 | 14 | 15 |
|---|---|---|---|
| Sulfimel/triton | 0/1.2 | 1/1.2 | 1/0.4 |
| Permeability | correct | low | low |
| ΔU | 3.1 | 3.7 | 3.5 |
| Yield | 88% at NaOH = 5 N | 72% at NaOH = 5 N | 79% at NaOH = 4.3 N |

The sulfimel thus contributes both to an increase in flow resistance and to the electrical resistance.

Examples 1.7 to 30

The method of the previous examples was followed, replacing the metal screen with a 2 mm mesh size with a Hooker S3B$^R$ electrolyzer unit with a 20 m$^2$ surface area in the form of a "glove finger".

This industrial operation resulted in a reduction in the deposit ratio of the PTFE and silica which were respectively 80% and 90%, the deposit ratio being calculated by a simple material balance in the suspension bath:measurement of elements F, Mg and Si by X ray fluorescence.

The intensity was 34 kA.

The dry matter content in the suspension was about 4.1%.

The compositions, conditions and results are summarized in Table 4 below.

The weight deposited corresponded to the dry weight of the precathode (about 5 kg) and that of the deposited diaphragm.

Examples marked "bis" are examples with the same number, the sole difference being in the weight deposited.

TABLE 4

| | COMPOSITION OF SUSPENSION | | | PTFE/SILICA RATIO | | DEPOS- | PROPERTIES | | | |
|---|---|---|---|---|---|---|---|---|---|---|
| Ex. | Asbestos (g) | Silica (g) | PTFE (g) | SUSPEN-SION | DEPOSITED DIAPHRAGM | ITED WT (KG) | DU (V) | NaOH (g/l) | Yield (%) | Permea-bility |
| 17 | 100 | 42 | 37 | 0.88 | 0.78 | 25 | 3.25 | 132 | 94.3 | correct |
| 17 | | | | | | 29.5 | 3.25 | 135 | 91.9 | |
| bis | 100 | 41 | 36 | 0.88 | 0.78 | 36 | 3.22 | 153 | 84.7 | |
| 18 | | | | | | 33 | 3.24 | 141 | 92.3 | |
| 18 | 100 | 35 | 29 | 0.83 | 0.75 | 33 | 3.19 | 119 | 96.1 | |
| bis | | | | | | 28 | 3.15 | 111 | 96.8 | |
| 19 | 100 | 30 | 27 | 0.90 | 0.81 | 33 | 3.36 | 141 | 94.1 | |
| 19 | | | | | | 31 | 3.47 | 135 | 95.1 | |
| bis | 100 | 31 | 30 | 0.97 | 0.87 | 36.5 | 3.53 | 153 | 91.1 | |
| 20 | | | | | | 30 | 3.11 | 163 | 75.9 | |
| 20 | | | | | | | | | | |
| bis | | | | | | | | | | |
| 21 | | | | | | | | | | |
| 21 | | | | | | | | | | |
| bis | | | | | | | | | | |
| 22 | 100 | 36 | 38 | 1.05 | 0.95 | 39 | 3.33 | 154 | 97.3 | FAIRLY |
| 22 bis | | | | | | 35.5 | 3.36 | 167 | 83.8 | LOW |
| 23 | 100 | 34 | 37 | 1.09 | 0.98 | 38 | 3.44 | 143 | 94.3 | |
| 23 bis | | | | | | 36.5 | 3.22 | 140 | 91.7 | |
| 24 | 100 | 31 | 33 | 1.06 | 0.95 | 37 | 3.42 | 141 | 91.9 | |
| 24 bis | | | | | | 35.5 | 3.36 | 146 | 91.4 | |
| 25 | 100 | 30 | 31 | 1.03 | 0.93 | 34.5 | 3.33 | 147 | 90.3 | |
| 25 bis | | | | | | 32 | 3.35 | 148 | 87.3 | |
| 26 | 100 | 30 | 33 | 1.10 | 0.99 | 35.5 | 3.32 | 155 | 86.3 | |
| 26 bis | | | | | | 35 | 3.27 | 151 | 88.3 | |
| 27 | 100 | 33 | 37 | 1.12 | 1.01 | 34 | 3.34 | 155 | 86.8 | |
| 27 bis | | | | | | 35 | 3.4 | 148 | 90.7 | |
| 28 | 100 | 32 | 36 | 1.12 | 1.01 | 33.5 | 3.28 | 147 | 90.6 | |
| 28 bis | | | | | | 33.5 | 3.33 | 147 | 89.4 | |
| 29 | 100 | 42 | 33 | 0.79 | 0.71 | 44 | 3.52 | 165 | 87.9 | LOW |
| 29 bis | | | | | | 48 | 3.64 | 155 | 91.5 | |
| 30 | 100 | 40 | 36 | 0.90 | 0.81 | 41 | 3.43 | 163 | 87.8 | |
| 30 bis | | | | | | 41 | 3.5 | 154 | 88.9 | |

Examples 31 to 33

The following suspensions were prepared:

X=50 g of PTFE;

Y varied: 30, 50 and 70 g of silica;

Z=1.2 g of Triton X 100$^R$ from ROHM & HAAS (30 ml of 40 g/l Triton x 100$^R$).

The deposit ratios of the precathode coating constituting the porous material were 100% (deposit ratio calculated by simple material balance: measurement of elements F, Mg and Si by X ray fluorescence and/or by weighing).

The example corresponding to 50 g of PTFE and 30 g of silica was thus a comparative example, since the PTFE/silica ratio was 1.7.

The results are summarized in Table 5 below.

The low silica content with respect to PTFE resulted in very low permeability and very high tension. The caustic soda yield was very low and production of caustic soda with a concentration of between 3.3N and 4.5N was impossible (for a deposited weight of 1.3 kg/m$^2$) employing an acceptable range of hydraulic load between the anodic and cathodic compartments.

TABLE 5

| EXAMPLES | 31 | | 32 | | 33 | |
|---|---|---|---|---|---|---|
| Composition of asbestos/ PTFE/silica | 100/50/30 | | 100/50/50 | | 100/50/70 | |

TABLE 5-continued

| EXAMPLES | 31 | | 32 | | 33 | |
|---|---|---|---|---|---|---|
| suspension | | | | | | |
| Wt deposited (kg/m$^2$) | 1.3 | 1.7 | 1.3 | 1.7 | 1.3 | 1.7 |
| Permeability | Very low | Very low | correct | low | correct | correct |
| ΔU (volt) | 3.60 | 3.70 | 3.10 | 3.35 | 3.00 | 3.25 |
| Yield (%) | | | | | | |
| of 3.5 N NaOH | impossible | 89 | 95 | 95 | 95 | 96 |
| of 4.5 N NaOH | impossible | 83 | 91 | 88 | 90 | 92.5 |
| of 5 N NaOH | impossible | 80 | 85 | 85 | 88 | 88 |

Examples 34 and 35

These tests measured the time required to deposit the suspension to produce the diaphragm (run-out time).

The following suspension was prepared in accordance with Example 1, with stirring:

B=1.2 g of Triton X 100$^R$ from ROHM & HAAS (30 ml of 40 g/l Triton x 100$^R$);

C=100 g of asbestos fibers;

D=25 g of PTFE;

E=30 g of silica.

The suspension for Example 34 further contained 1.5 g of xanthane gum; that of Example 35 contained none.

The suspension was filtered by programmed vacuum filtration through a bulk cathode prepared in accordance with Example 7 of European patent application EP-A-0 296 076, as follows:

1 minute at a relative pressure of −5 to −10 mbar with respect to atmospheric pressure;

reduction of pressure at a rate of 50 mbar/min.

The measured run-out time was 40 minutes for Example 34 and 5 minutes for Example 35.

These results show that quantities of xanthane gum of less than 1.5 parts by weight with respect to 100 parts by weight of asbestos fibers are preferable in order to obtain a process for the preparation of a diaphragm in accordance with the invention which is capable of industrial exploitation.

We claim:

1. A diaphragm comprising:

a) 100 parts by weight of asbestos fibers;

b) 30 to 70 parts by weight of silica-based derivatives;

c) 20 to 60 parts by weight of fluorinated polymer; and d) optionally including a thickening agent in an amount of less than 1.5 parts by dry weight per 100 parts by dry weight of asbestos fibers deposited on a porous material, wherein the ratio of fluorinated polymer to silica-based derivatives is between about 0.6 and about 1.2 by weight with the exception of a diaphragm obtained by depositing a suspension containing 100 parts by dry weight of asbestos fibers, 30 parts by dry weight of silica-based derivatives, 25 parts by dry weight of fluorinated polymer and 1.5 parts by dry weight of thickening agent.

2. The diaphragm according to claim 1, wherein the ratio of fluorinated polymer to silica-based derivatives is between 0.6 and about 0.9 by weight.

3. The diaphragm according to claim 1 comprising:

a) 100 parts by weight of asbestos fibers;

b) 30 to 60 parts by weight of silica-based derivatives; and c) 25 to 50 parts by weight of fluorinated polymer.

4. The diaphragm according to claim 1, containing 0 to 1 part by dry weight of a thickening agent per 100 parts by dry weight of asbestos fibers.

5. The diaphragm according to claim 1, containing at least one surfactant in a quantity of between about 0.5 and 10 parts by weight per 100 parts by weight of asbestos fibers.

6. The diaphragm according to claim 5 wherein the quantity of surfactant is between about 0.6 and about 5 parts by weight per 100 parts by weight of asbestos fibers.

7. The diaphragm according to claim 1, wherein the surfactant is non ionic.

8. The diaphragm according to claim 1, wherein the porous material is a microporous metallic surface constituting an elementary cathode.

9. The diaphragm according to claim 1, wherein the porous material is an elementary cathode coated with a precathodic coating.

10. A process for the preparation of a diaphragm according to claim 1, comprising:

a) preparing an aqueous suspension comprising:

100 parts by dry weight of asbestos fibers;

30 to 60 parts by dry weight of silica-based derivatives;

20 to 60 parts by dry weight of fluorinated polymer; and optionally a thickening agent;

b) depositing a coating by programmed vacuum filtration of said suspension through a porous material;

c) eliminating the liquid medium and drying the coating formed; and d) sintering the coating;

the prepared suspension having a weight ratio of fluorinated polymer to silica-based derivatives such that the diaphragm produced has a ratio of fluorinated polymer to silica-based derivatives, following step c), of between 0.6 and 1.2 by weight, with the exception of a diaphragm obtained by depositing a suspension comprising 100 parts by dry weight of asbestos fibers, 30 parts by dry weight of silica-based derivatives, 25 parts by dry weight of fluorinated polymer and 1.5 parts by dry weight of a thickening agent.

11. The process according to claim 10, wherein the prepared aqueous suspension comprises:

100 parts by dry weight of asbestos fibers;

35 to 50 parts by dry weight of silica-based derivatives; and 30 to 40 parts by dry weight of fluorinated polymer.

12. The process according to claim 10, wherein the aqueous suspension from step a) contains 0 to 1 part dry weight of a thickening agent.

13. The process according to claim 10, wherein the aqueous suspension contains at least one surfactant.

14. The process according to claim 10, wherein the fluorinated polymer used is a polytetrafluoroethylene.

15. The process according to claim 10, wherein the porous material is a microporous metallic surface with a mesh size or perforations of between 1 μm and 5 nm.

16. The process according to claim 15, wherein a precathodic coating is deposited prior to the deposition of step b), carried out by programmed vacuum filtration, through the metallic surface, of an aqueous suspension of fibers a portion of which are electrical conductors, a fluorinated polymer based binder in the form of particles and, optionally, additives, followed by elimination of the liquid medium, optional drying of the coating formed and optional sintering of the coating.

17. A process for the preparation of a diaphragm according to claim 1, comprising:

a) preparing an aqueous suspension comprising 100 parts by dry weight of asbestos fibers;

30 to 60 parts by dry weight of silica-based derivatives;

20 to 60 parts by dry weight of fluorinated polymer; and 0 to less than 1.5 parts by dry weight of a thickening agent;

b) depositing a coating by programmed vacuum filtration of said suspension through a porous material;

c) eliminating the liquid medium and drying the coating formed; and d) sintering the coating; the prepared suspension having a weight ratio of fluorinated polymer to silica-based derivatives such that the diaphragm produced has a ratio of fluorinated polymer to silica-based derivatives, following step c), of between 0.6 and 1.2 by weight.

18. An electrolyzer unit for aqueous alkali halides comprising the diaphragm according to claim 1.

19. The diaphragm according to claim 1, said diaphragm having electrical and hydraulic properties to provide uniform electrolyte flow, and withstands weakening after several hours of electrolysis yet not so is hydrophobic to provide high tension and low permeability.

20. A diaphragm comprising:

a) 100 parts by weight of asbestos fibers;

b) 30 to 70 parts by weight of silica-based derivatives;

c) 20 to 60 parts by weight of fluorinated polymer; and d) optionally including a thickening agent in an amount of less than 1.5 parts by dry weight per 100 parts by dry weight of asbestos fibers deposited on a porous material, wherein the ratio of fluorinated polymer to silica-based derivatives is between 0.6 and 1.2 by weight.

21. The diaphragm according to claim 20, wherein the ratio of fluorinated polymer to silica-based derivatives is between 0.6 and about 0.9 by weight.

* * * * *